US011584573B2

(12) United States Patent
Bernstein et al.

(10) Patent No.: US 11,584,573 B2
(45) Date of Patent: Feb. 21, 2023

(54) SYSTEM AND DEVICE FOR SUPPORTING A CANDLE ON A DRINK CUP

(71) Applicant: Cakeless Candle, LLC, Palm Beach, FL (US)

(72) Inventors: Lori Bernstein, Palm Beach, FL (US); Yara Bashoor, Fort Lauderdale, FL (US)

(73) Assignee: Cakeless Candle, LLC, Palm Beach, FL (US)

( * ) Notice: Subject to any disclaimer, the term of this patent is extended or adjusted under 35 U.S.C. 154(b) by 89 days.

(21) Appl. No.: 17/116,331

(22) Filed: Dec. 9, 2020

(65) Prior Publication Data

US 2021/0179327 A1 Jun. 17, 2021

Related U.S. Application Data

(60) Provisional application No. 62/948,070, filed on Dec. 13, 2019.

(51) Int. Cl.

| | |
|---|---|
| ***B65D 51/24*** | (2006.01) |
| ***B65D 51/16*** | (2006.01) |
| ***A47G 19/22*** | (2006.01) |

(52) U.S. Cl.

CPC ..... *B65D 51/248* (2013.01); *A47G 19/2227* (2013.01); *B65D 51/1672* (2013.01); *B65D 51/245* (2013.01); *A47G 2019/2238* (2013.01)

(58) Field of Classification Search

CPC ..... B65D 2203/00; B65D 2203/12; B65D 55/028; B65D 51/248; B65D 51/1672; B65D 51/245; A47G 19/2227; A47G 2019/2238; A47G 2400/061; F21V 35/003

See application file for complete search history.

(56) References Cited

U.S. PATENT DOCUMENTS

| | | | | |
|---|---|---|---|---|
| 8,459,456 | B2 * | 6/2013 | Donnelly | F21V 35/00 431/295 |
| 2006/0288641 | A1 * | 12/2006 | Cardamone | A01G 5/04 47/41.01 |
| 2008/0272019 | A1 * | 11/2008 | Miller | B65D 81/365 431/295 |
| 2009/0109663 | A1 * | 4/2009 | Tsai | A61L 9/122 362/190 |
| 2013/0115339 | A1 * | 5/2013 | Saha | G01B 11/18 426/104 |
| 2014/0138379 | A1 * | 5/2014 | Hill | B65D 51/24 215/229 |
| 2016/0143465 | A1 * | 5/2016 | Anderson | A47G 19/2227 220/694 |
| 2016/0327262 | A1 * | 11/2016 | Harris | A47G 19/2227 |
| 2018/0215507 | A1 * | 8/2018 | Ingram | B65D 25/205 |
| 2019/0367230 | A1 * | 12/2019 | Griffis | B65D 51/28 |

* cited by examiner

*Primary Examiner* — Kareen K Thomas
(74) *Attorney, Agent, or Firm* — McHale & Slavin, P.A.

(57) ABSTRACT

The invention involves a device and system for securing a candle to a drink cup for celebrations. The system includes a cover that secures across the top surface of the drink cup. A center portion of the cover is provided with a depression sized and shaped to cooperate with a small candle base to secure the candle in an upright position with respect to the longitudinal centerline of the drink cup. Once the candle has been blown out by the recipient, the cover can be removed from the drink cup to allow the person to consume the beverage contained within the cup.

12 Claims, 8 Drawing Sheets

SYSTEM AND DEVICE FOR SUPPORTING A CANDLE ON A DRINK CUP

PRIORITY CLAIM

In accordance with 37 C.F.R. 1.76, a claim of priority is included in an Application Data Sheet filed concurrently herewith. Accordingly, the present invention claims priority to U.S. Provisional Patent Application No. 62/948,070, entitled "SYSTEM AND DEVICE FOR SUPPORTING A CANDLE ON A DRINK CUP", filed Dec. 13, 2019. The contents of the above referenced application are incorporated herein by reference in their entirety.

FIELD OF INVENTION

The present invention generally relates to celebrations, and more particularly, to a device and system for securing a candle to a drink cup.

BACKGROUND INFORMATION

Birthdays, as well as other celebrations in Western European countries, are often celebrated with cakes. The cakes are often adorned with candles to celebrate age or other accomplishments. This tradition may date back to Roman times.

In classical Roman culture, cakes were occasionally served at special birthdays and at weddings. These were flat circles made from flour and nuts, leavened with yeast, and sweetened with honey.

In the 15th century, bakeries in Germany began to market one-layer cakes for customer's birthdays, as opposed to only marketing cakes for weddings, and thus the modern birthday cake was born. During the 17th century, the birthday cake took on its contemporary form. These elaborate 17th century cakes had many aspects of the contemporary birthday cake, like multiple layers, icing, and decorations. However, these cakes were only available to the very wealthy. Birthday cakes became accessible to the lower class as a result of the industrial revolution and the spread of more materials and goods.

In contemporary Western cultures, the birthday cake is often decorated with small candles, secured with special holders or simply pressed down into the cake. In the UK, North America and Australia, the number of candles is equal to the age of the individual whose birthday it is, sometimes with one extra for luck. Traditionally, the person whose birthday it is makes a wish, which is thought to come true if all the candles are extinguished in a single breath.

While there are multiple theories that attempt to explain the origin of the birthday candle tradition, the actual origin is unknown. Through the years, the manner in which people gather to celebrate birthdays have changed. The celebrations are often held at restaurants where attendees celebrate with food and drink. In these gatherings, cake is not the focal point of the gathering. Instead, it is the fellowship of the group that takes precedence. In these gatherings, the participants still want to practice part of the old traditions. For example, the blowing out of a candle to grant a wish made by the birthday boy or girl. To accommodate this tradition, restaurants commonly serve a cup cake with a lit candle pushed into its center. The birthday participant makes a wish and blows out the candle. The cup cake is often discarded as too small to share with the group.

Thus, there is a need for new ways to practice older traditions, namely that of providing a lit birthday candle to one celebrating a birthday. In order to achieve acceptance by the end user, the system or device for providing a lit birthday candle to the person having the birthday must be easily and quickly assembled using minimal hardware and requiring a minimal number of components. Moreover, the system must assemble together in such a way so as not to detract from the aesthetic appearance of the lit candle.

Thus, the present invention provides a device and system for securing a lit candle to a drink cup. The device and system of the present invention provides for relative ease in the assembly, and provides a device for securing a lit candle safely to a drink cup; it also permits transport of the lit candle through restaurants, homes and the like without the need to carry the drink and candle to the table before being lit, adding to the atmosphere of the celebration as the lit candle is transported.

SUMMARY OF THE INVENTION

Briefly, the invention involves a device and system for securing a candle to a drink cup for celebrations. The system includes a cover that secures across the top surface of the drink cup utilizing a small vacuum created under the device to secure the device firmly in position. The underside of the device is sufficiently soft and pliable to create a seal around the rim of the glass to maintain the vacuum and to secure the device in position. A center portion of the cover is provided with a depression sized and shaped to cooperate with a small candle base to secure the candle in an upright position with respect to the longitudinal centerline of the drink cup. Once the candle has been blown out by the recipient, the cover can be removed from the drink cup by gently lifting on the edge of the device to allow the person to consume the beverage contained within the cup.

Accordingly, it is an objective of the present invention to provide a device and system for securing a candle to a drink cup for celebrations.

It is a further objective of the present invention to provide a drink cup topper that includes a socket for securing a candle to the drink cup topper.

It is yet a further objective of the present invention to provide a flexible cup topper constructed and arranged to support a candle, the cup topper utilizing vacuum to secure the cup topper to a drink cup.

It is another objective of the present invention to provide a rigid cup topper having at least one depending rim for positioning the cup topper on a drink cup.

It is still yet another objective of the present invention to provide a rigid cup topper having a plurality of depending rims for positioning the cup topper on a plurality of drink cups having different diameters.

Other objectives and advantages of this invention will become apparent from the following description taken in conjunction with the accompanying drawings wherein are set forth, by way of illustration and example, certain embodiments of this invention. The drawings constitute a part of this specification, include exemplary embodiments of the present invention, and illustrate various objects and features thereof.

DETAILED DESCRIPTION OF THE PREFERRED EMBODIMENTS

Figure 1:
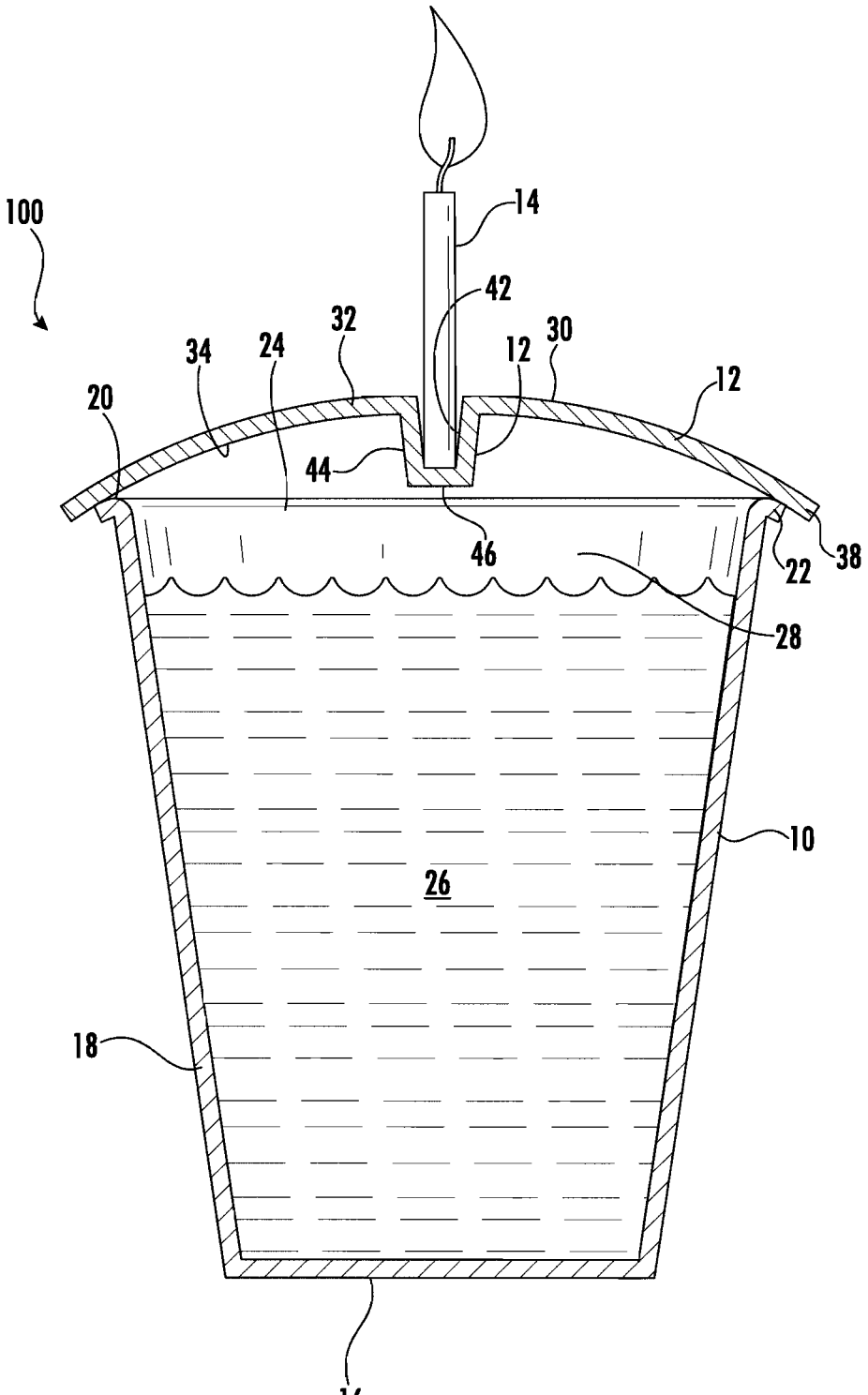
FIG. 1 is a section view of one embodiment of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

Figure 2:
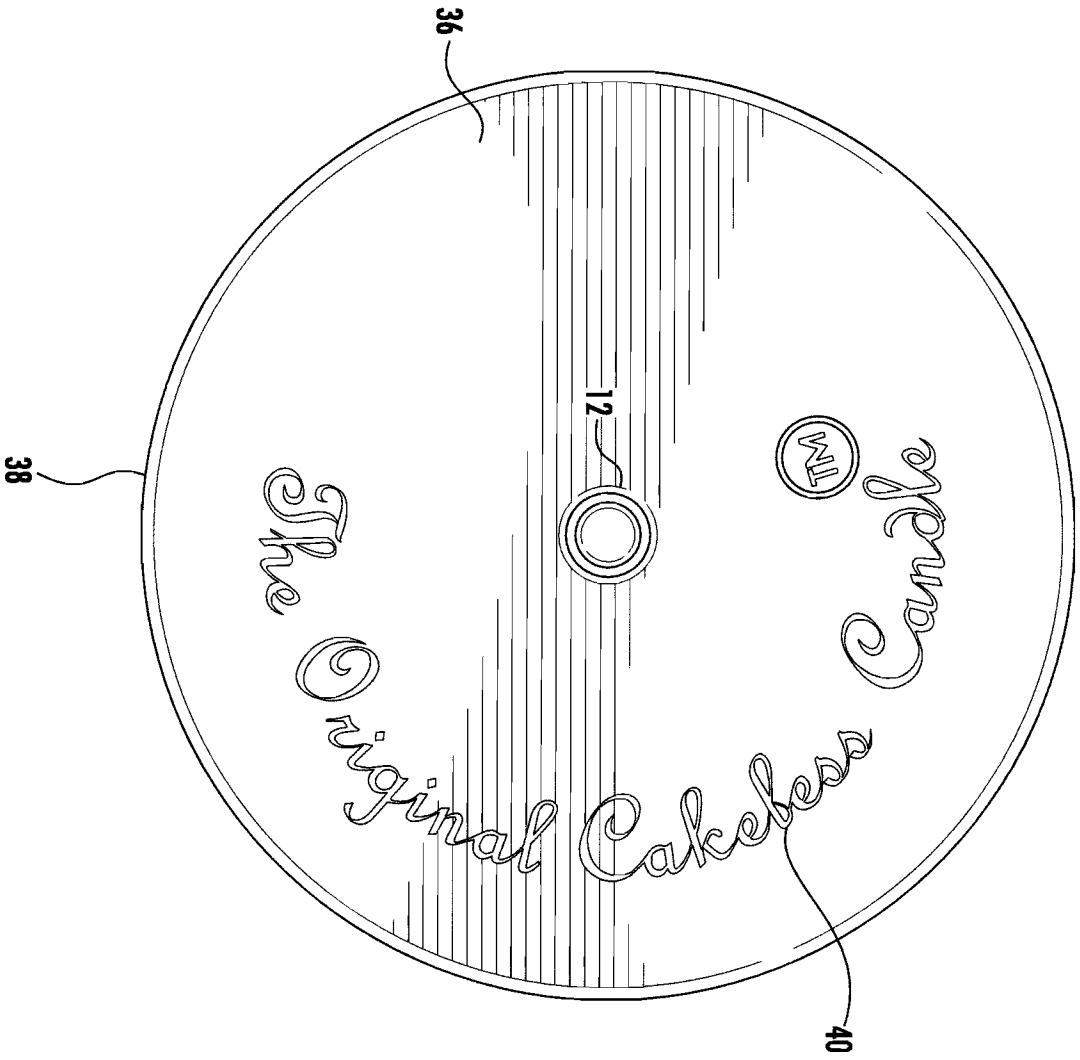
FIG. 2 is a top view of the embodiment shown in FIG. 1, illustrating the ability to add advertising indicia to the top surface of the device.
Figure 3:
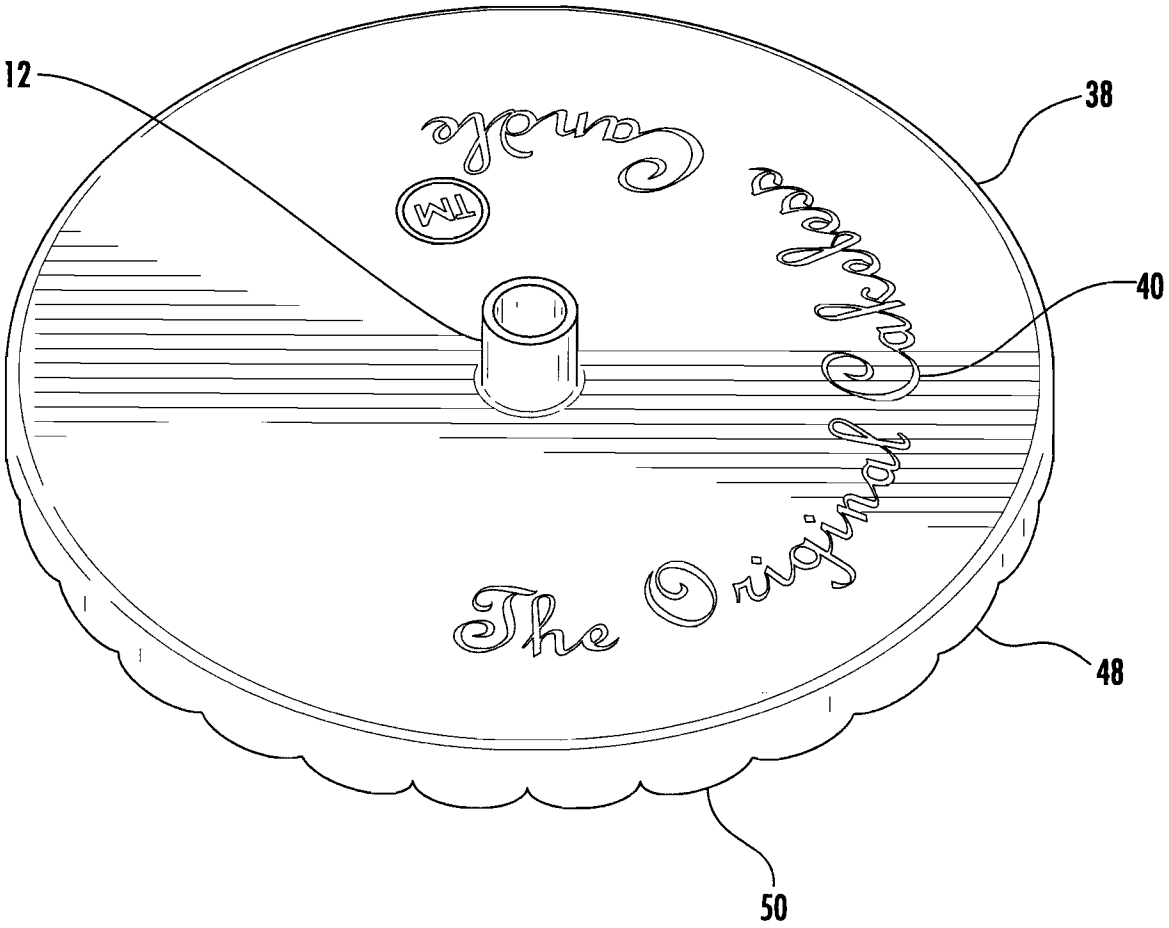
FIG. 3 is a perspective view of one embodiment of the present device, illustrating the depending rim and an upstanding candle socket.

Referring generally to FIGS. 1-6, a celebration device and system 100 for securing a candle to a drink cup 10 is illustrated. The system includes a candle support member 12 and a candle 14. The drink cup 10 includes a bottom 16, a side wall 18 and a top rim 20. In some embodiments, the top rim 20 includes a depending lip 22. The drink cup 10 components are connected together to create a watertight hollow liquid container 28 having an open mouth 24 for allowing liquid 26 from within the drink cup 10 to be consumed by a user. The celebration device 100 of the preferred embodiment includes a candle support 30 having a preferably spherically shaped topper member 32 constructed from a material, such as silicon, to be flexible. The topper member 32 includes a lower surface 34, an upper surface 36, a candle support member 12, and a perimeter edge 38. The lower surface 34 of the topper member 32 in this embodiment is preferably compliant to conform to the shape of the top rim 20 of the drink cup 10. The upper surface 36 is generally smooth and may include indicia 40 for advertising, greetings, jokes and the like. The upper surface 36 includes a candle support member 12 that is constructed and arranged to cooperate with a birthday candle 14 or the like in an upright position. The candle support member 12 may extend inwardly as illustrated on FIG. 1, or outwardly as illustrated in FIGS. 2 and 3 without departing from the scope of the invention. The candle support member 12 includes a candle support member inner wall 42, a candle support member outer wall 44, and may include a candle support member bottom wall 46. The candle support member inner wall 42 is sized to cooperate with the outer surface of a candle member 14 to firmly hold the candle in an upright position. Tapers, threads, ridges, or the like may be incorporated into the inner wall 42 to more firmly grip the candle 14 without departing from the scope of the invention. The perimeter edge 38 of the topper member 32 may be round, scalloped, or may include any other edge decoration suitable for use with the present device. In this manner, the candle support member 12 can be loaded with a candle 14, the celebration device 100 can be placed on the top rim 20 of the drink cup 10, and a central portion of the celebration device 100 can be pressed downward slightly to expel a small amount of air from the drink cup 10. The lower surface 34 of the candle support member 12 conforms to the top rim 20 to maintain a small amount of vacuum within the container 28 to retain the celebration device 100 in position for use. Thus, while it is preferred that the celebration device is spherically shaped, it should be appreciated by those skilled in the art that the celebration device may be provided as flat, conical, frustoconical, or any suitable combination of shapes that allow the small amount of downward pressure applied to the device to create a vacuum inside of the drinking vessel.

Referring generally to the figures, and more specifically to FIG. 2, one embodiment of the celebration device 100 is illustrated. In this embodiment, the celebration device 100 is provided with an outwardly extending candle support member 12, indicia 40 on the upper surface 36, and a smooth and round perimeter edge 38.

Referring generally to the figures, and more specifically to FIG. 3, one embodiment of the celebration device 100 is illustrated. In this embodiment, the celebration device 100 is provided with an outwardly extending candle support member 12, indicia 40 on the upper surface 36, and a perimeter edge 38 that includes a depending ring 48 and a scalloped bottom edge 50. This embodiment also includes a substantially flat, within general manufacturing tolerances, upper surface 36. The embodiment may also be constructed as a rigid member from polymeric materials such as plastic or the like.

Figure 4:
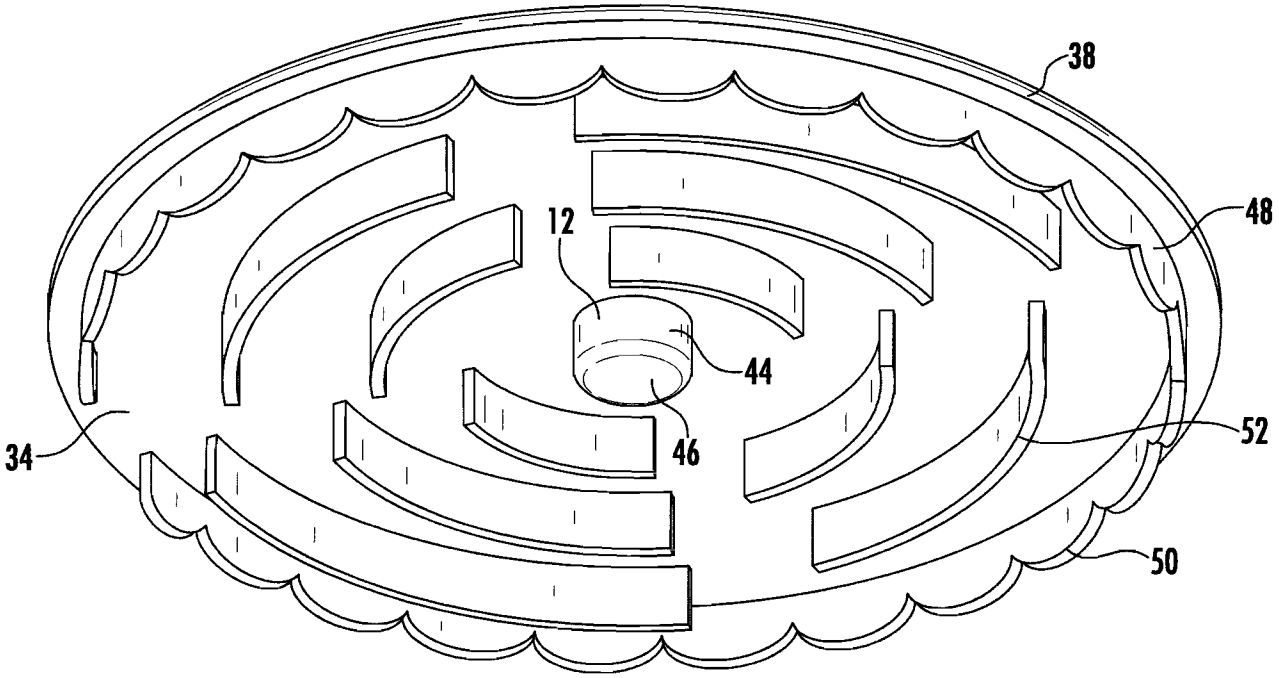
FIG. 4 is a bottom perspective view of the embodiment illustrated in FIG. 3 having an inward candle socket.

Referring generally to the figures, and more specifically to FIG. 4, one embodiment of the celebration device 100 is illustrated. In this embodiment, the celebration device 100 is provided with an inwardly extending candle support member 12 and a perimeter edge 38 that includes an inset depending ring 48 and a scalloped bottom edge 50. This embodiment also includes a substantially flat, within general manufacturing tolerances, lower surface 34. This embodiment also illustrates a plurality of depending locating ring segments 52. The locating ring segments 52 provide various diameters sized to cooperate with the inner or outer diameters of the top rim 20 of the drink cup 10. The embodiment may also be constructed as a rigid member from polymeric materials such as plastic or the like.

Figure 5:
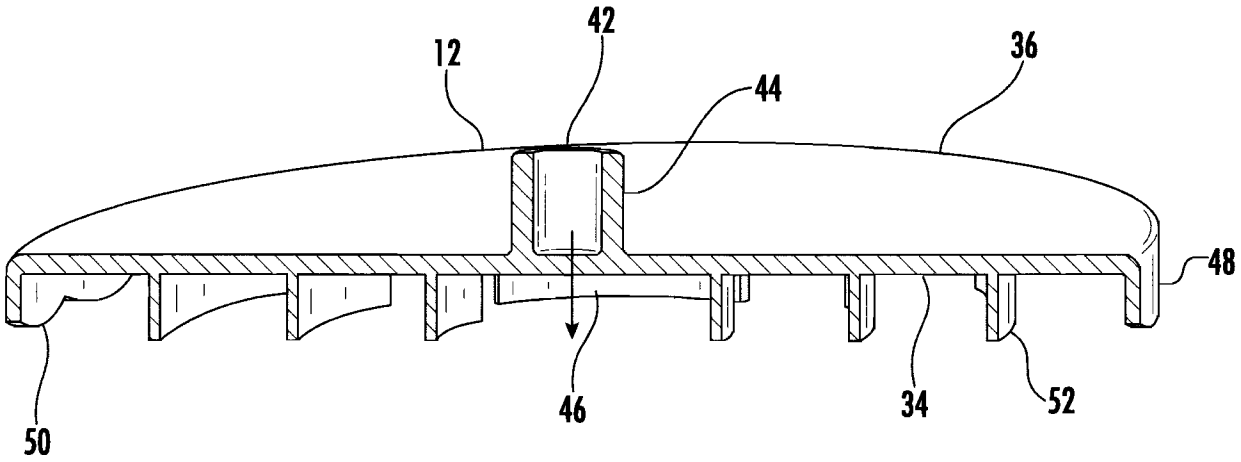
FIG. 5 is a perspective section view of the embodiment illustrated in FIG. 3.

Referring generally to the figures, and more specifically to FIG. 5, one embodiment of the celebration device 100 is illustrated. In this embodiment, the celebration device 100 is provided with an outwardly extending candle support member 12 and a perimeter edge 38 that includes a depending ring 48 and a scalloped bottom edge 50. This embodiment also includes a substantially flat, within general manufacturing tolerances, lower surface 34. This embodiment also illustrates a plurality of depending locating ring segments 52. The locating ring segments 52 provide various diameters sized to cooperate with the inner or outer diameters of the top rim 20 of the drink cup 10. The embodiment may also be constructed as a rigid member from polymeric materials such as plastic or the like.

Figure 6:
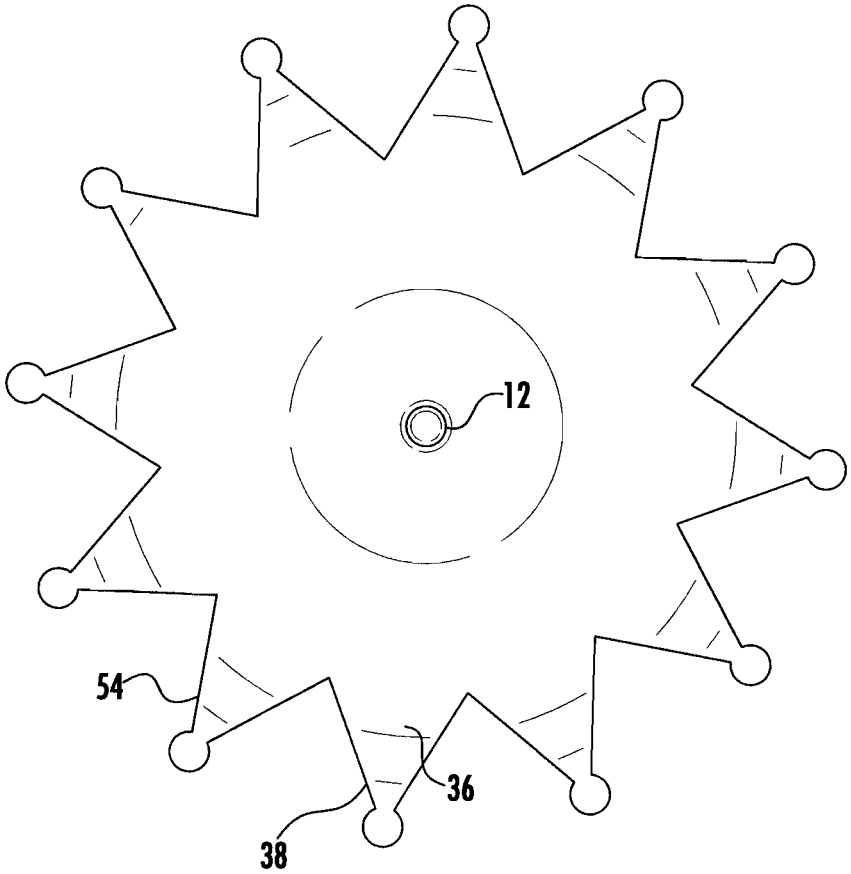
FIG. 6 is a top view illustrating one embodiment of the present device having a shaped outer perimeter.
Figure 7:
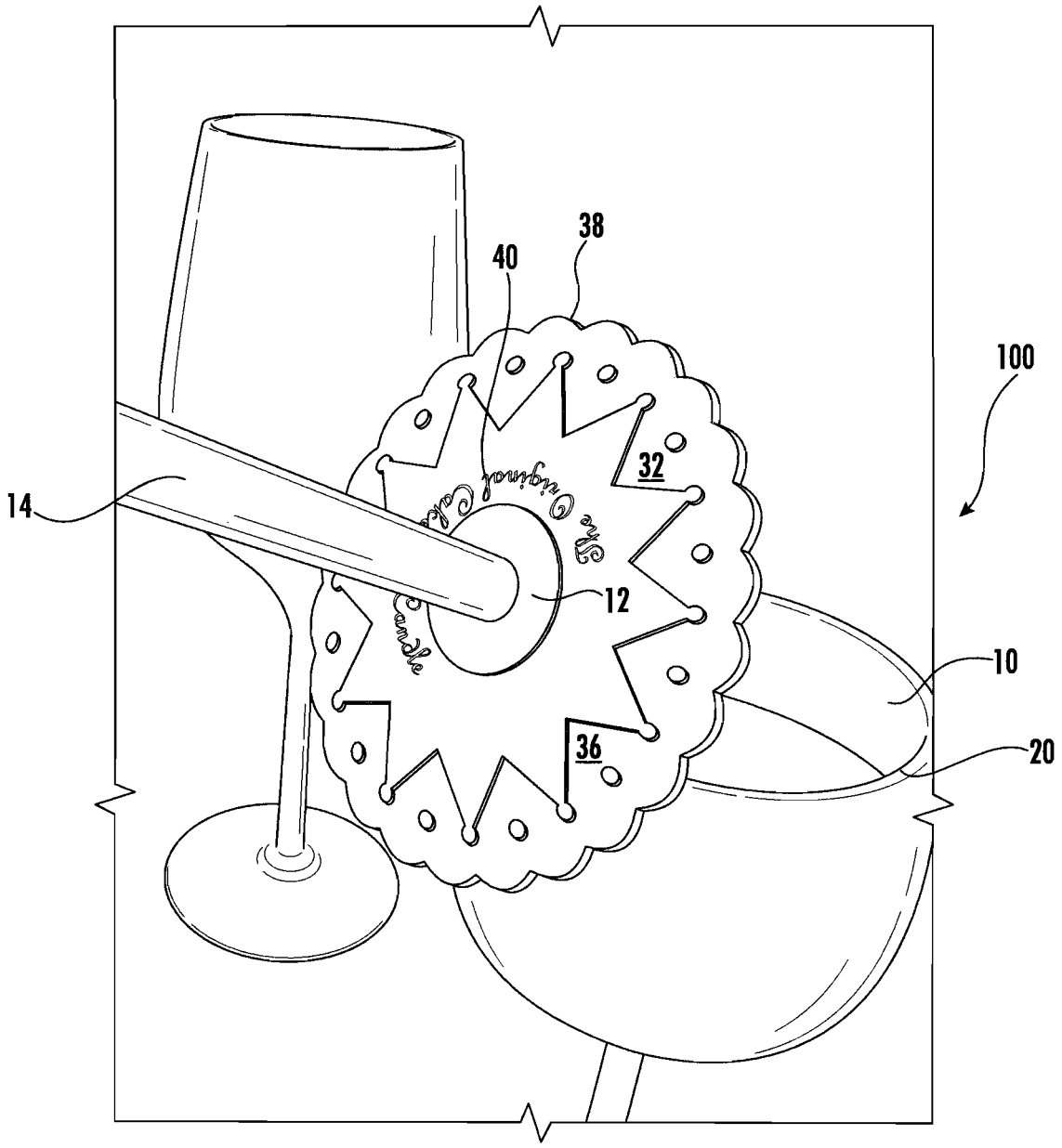
FIG. 7 is a perspective view of one embodiment of the present device.
Figure 8:
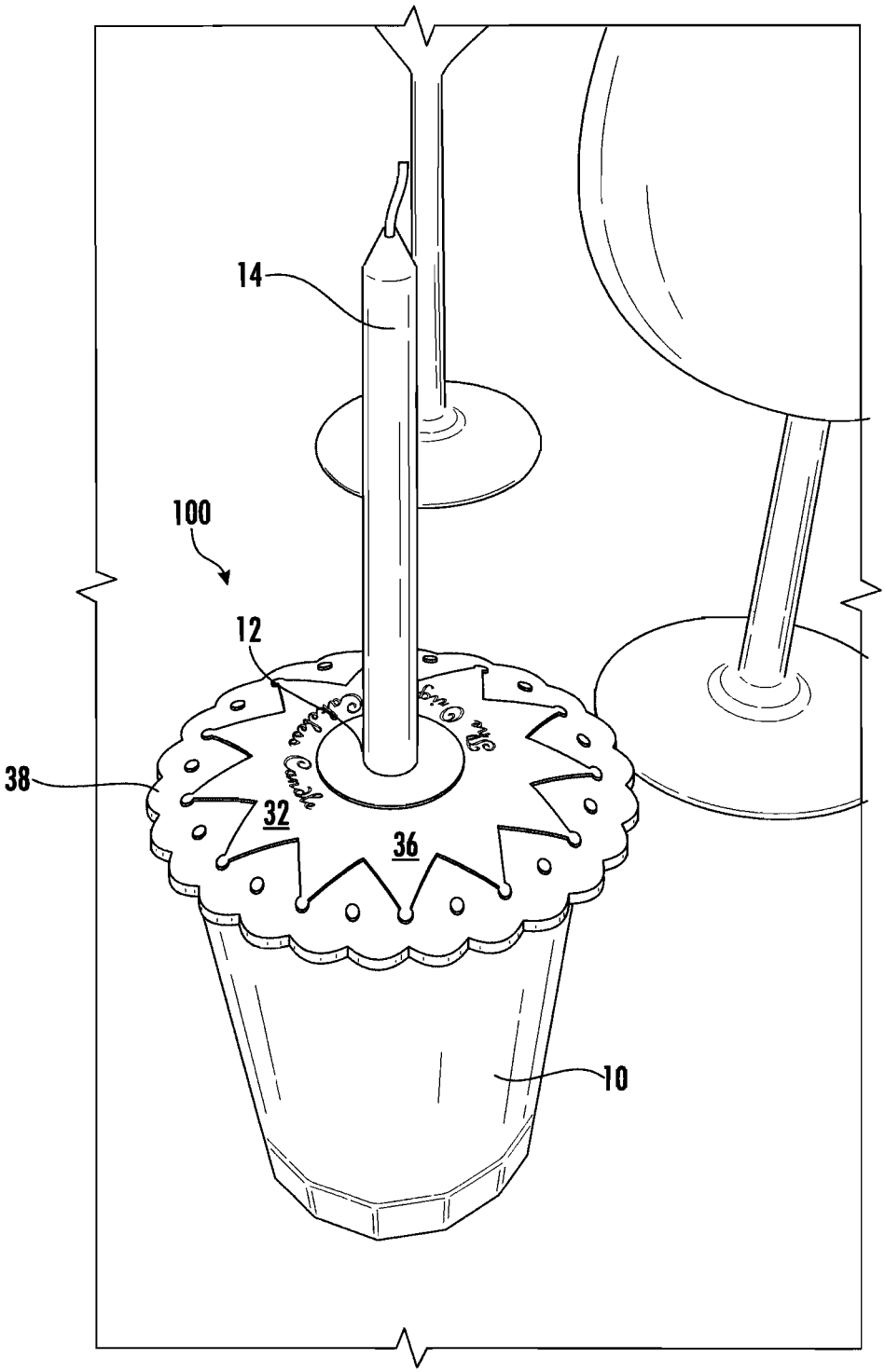
FIG. 8 is a perspective view of the embodiment illustrated n FIG. 7 cooperating with a shot glass.

Referring generally to the figures, and more specifically to FIG. 6, one embodiment of the celebration device 100 is illustrated. In this embodiment, the celebration device 100 is provided with an inwardly extending candle support member 12 and a perimeter edge 38 that includes a contoured design 54.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objects and obtain the ends and advantages mentioned, as well as those inherent therein. Any compounds, methods, procedures, and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A celebration device for securing a candle to a drink cup comprising:

a topper member (32) constructed from a material that is sufficiently flexible to allow the topper member to expel a portion of air from the drinking cup (10) when a central portion of the celebration device is flexed inwardly with respect to an inner portion of the drinking cup, the topper member (32) includes a lower surface (34), an upper surface (36), a candle support member (12), and a perimeter edge (38), the lower surface (34) of the topper member (32) is compliant to conform to a shape of a top rim (20) of the drink cup (10) when placed on the top rim (20) to maintain an air seal between the lower surface and the drinking cup rim forming a partial vacuum inside of the drinking cup to hold the celebration device in position with respect to the drinking cup, the upper surface (36) includes the candle support member (12) that is constructed and arranged to cooperate with a birthday candle (14) in an upright position, the candle support member (12) includes a candle support member inner wall (42), a candle support member outer wall (44), and a candle support member bottom wall (46), the candle support member inner wall (42) is sized to cooperate with the outer surface of a candle member (14) to firmly hold the candle in an upright position.

2. The celebration device for securing a candle to a drink cup of claim 1 wherein the candle support member (12) extends inwardly into the upper surface (36).

3. The celebration device for securing a candle to a drink cup of claim 1 wherein the candle support member (12) extends above the upper surface (36).

4. The celebration device for securing a candle to a drink cup of claim 1 wherein the perimeter edge (38) of the topper member (32) is scalloped.

5. The celebration device for securing a candle to a drink cup of claim 1 wherein the topper member (32) is convex when viewed from the top.

6. The celebration device for securing a candle to a drink cup of claim 1 wherein the topper member (32) is spherical when viewed from the top.

7. The celebration device for securing a candle to a drink cup of claim 1 wherein the topper member (32) is flat when viewed from the top.

8. The celebration device for securing a candle to a drink cup of claim 1 wherein the upper surface (36) includes indicia (40).

9. The celebration device for securing a candle to a drink cup of claim 1 wherein the candle support member inner wall (42) includes a taper to more firmly grip the candle (14).

10. The celebration device for securing a candle to a drink cup of claim 1 wherein the candle support member inner wall (42) includes ridges to more firmly grip the candle (14).

11. The celebration device for securing a candle to a drink cup of claim 10 wherein the ridges are helical threads.

12. A celebration device for securing a candle to a drink cup comprising:

a topper member (32), the topper member (32) includes a lower surface (34), an upper surface (36), a candle support member (12), and a perimeter edge (38), wherein the lower surface (34) includes a plurality of depending locating ring segments (52), the locating ring segments (52) provide various diameters sized to cooperate with an inner or outer diameters of a top rim (20) of the drink cup (10) to position the topper member with respect to the drinking cup when placed on a top surface of the drink cup (10), the upper surface (36) of the topper member includes the candle support member (12) that is constructed and arranged to cooperate with a birthday candle (14) in an upright position, the candle support member (12) includes a candle support member inner wall (42), a candle support member outer wall (44), and a candle support member bottom wall (46), the candle support member inner wall (42) is sized to cooperate with an outer surface of a candle member (14) to firmly hold the candle in an upright position.

* * * * *